US007793792B2

(12) United States Patent
Seyler

(10) Patent No.: US 7,793,792 B2
(45) Date of Patent: Sep. 14, 2010

(54) DEATH CARE MERCHANDISE DISPLAY SYSTEM

(75) Inventor: Paul J. Seyler, New Orleans, LA (US)

(73) Assignee: Matthews Resources, Inc., Wilmington, DE (US)

( * ) Notice: Subject to any disclaimer, the term of this patent is extended or adjusted under 35 U.S.C. 154(b) by 5 days.

(21) Appl. No.: 11/846,288

(22) Filed: Aug. 28, 2007

(65) Prior Publication Data

US 2008/0067296 A1 Mar. 20, 2008

Related U.S. Application Data

(60) Provisional application No. 60/823,816, filed on Aug. 29, 2006.

(51) Int. Cl.
*A47G 29/00* (2006.01)

(52) U.S. Cl. ..... 211/85.16

(58) Field of Classification Search ..... 211/85.16, 211/85.27, 94.01, 78, 165, 205, 169, 196; 160/135; 52/36.1–36.6
See application file for complete search history.

(56) References Cited

U.S. PATENT DOCUMENTS 1,562,975 A * 11/1925 Leake ..... 211/28
3,181,706 A * 5/1965 Mandel ..... 211/163
3,337,059 A * 8/1967 Le Hoy ..... 211/107
4,339,164 A * 7/1982 Spevak ..... 312/283
4,442,942 A * 4/1984 Cuminale et al. ..... 211/163
4,548,324 A * 10/1985 Mackey, Jr. ..... 211/58
4,673,090 A * 6/1987 Crosslen ..... 211/183
5,226,548 A * 7/1993 Koeppel ..... 211/144
5,291,700 A * 3/1994 Chew ..... 52/36.1
5,622,010 A * 4/1997 Weber ..... 52/36.4
5,782,366 A * 7/1998 Garza, Jr. ..... 211/41.12
6,000,561 A * 12/1999 Schumacher ..... 211/165
6,276,034 B1 * 8/2001 Bachman et al. ..... 27/27
6,467,637 B2 * 10/2002 Riga ..... 211/94.01
6,951,291 B2 * 10/2005 Kleanthis ..... 211/163
7,036,196 B2 * 5/2006 Salatin et al. ..... 27/27
2001/0002660 A1 6/2001 Riga et al.
2001/0042727 A1 * 11/2001 Riga ..... 211/189
2002/0033372 A1 3/2002 Kellogg
2003/0000901 A1 * 1/2003 Salatin et al. ..... 211/85.16
2003/0226811 A1 12/2003 Riga
2005/0000926 A1 1/2005 Bowers et al.

* cited by examiner

*Primary Examiner*—Jennifer E. Novosad
(74) *Attorney, Agent, or Firm*—Reed Smith LLP

(57) ABSTRACT

A display system for death care merchandise. A display unit includes a vertical center post and a plurality of wall panels which are attachable to the center post at right angles to each other. Another display unit includes a freestanding, two-sided, portable display.

11 Claims, 11 Drawing Sheets

DEATH CARE MERCHANDISE DISPLAY SYSTEM

CROSS-REFERENCE TO RELATED APPLICATION

This application claims the benefit under 35 U.S.C. §119 (e) of the earlier filing date of U.S. Provisional Application Ser. No. 60/823,816 filed on Aug. 29, 2006, the disclosure of which is hereby incorporated by reference.

FIELD OF THE INVENTION

The present invention relates to a display system for death care merchandise such as caskets, coffins, urns, burial vaults and related accessories.

DESCRIPTION OF RELATED ART

Various death care display units are known in the art. Known display units include two tier displays for showing one casket above another one, as well as modular displays in the form of a three-sided alcove configuration. A need exists for portable death care merchandise displays and displays suitable for small spaces.

SUMMARY OF THE INVENTION

One embodiment of the death care merchandise display system of the present invention includes a vertical center post and a plurality of wall panels which are attachable to the center post at right angles to each other. The display unit of the present invention is space efficient and flexible as it may be placed in the center of a room away from walls. The present invention allows 8-12 casket fractions to be displayed in a minimum amount of space.

Another embodiment of the death care merchandise display system of the present invention includes a portable, double-sided, freestanding display suitable for small locations without permanent display space, lobby displays, additional merchandise selections or memory displays. This embodiment allows for 4-8 casket fractions to be displayed in a minimum amount of space. This freestanding display may be used in existing rooms without removing furniture.

BRIEF DESCRIPTION OF THE DRAWINGS

The present invention and its presently preferred embodiments will be better understood by way of reference to the detailed disclosure herebelow and to the accompanying drawings.

DETAILED DESCRIPTION OF THE PREFERRED EMBODIMENTS

A display system, indicated generally at 10, for death care merchandise constructed in accordance with the present invention is shown in FIGS. 1-12B. The display system includes a vertical center post 12 and a plurality of wall panels 14 which are attachable to the center post 12 at right angles to each other thereby forming four interior corners. The panels 14 are attached to the post 12 using hinge plates 16 (FIG. 6) mounted on the panels 14 and corresponding hinge plates 16 mounted on the center post. A hinge pin 18 is used to attach each pair of corresponding hinge plates 16 together. Other suitable attachment systems may also be used.

Figure 1:
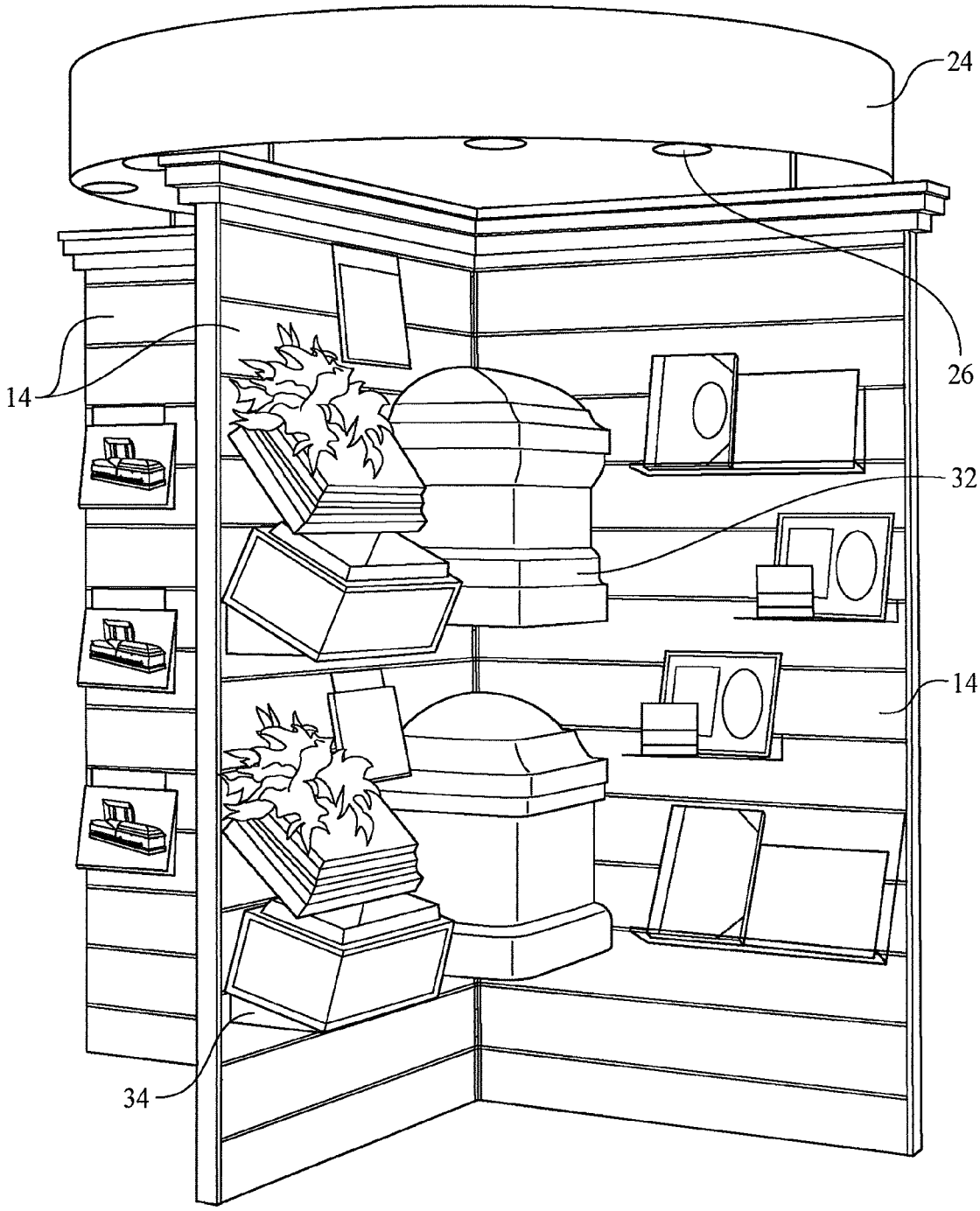
FIG. 1 is a perspective view of the merchandise display system according to the present invention.
Figure 2:
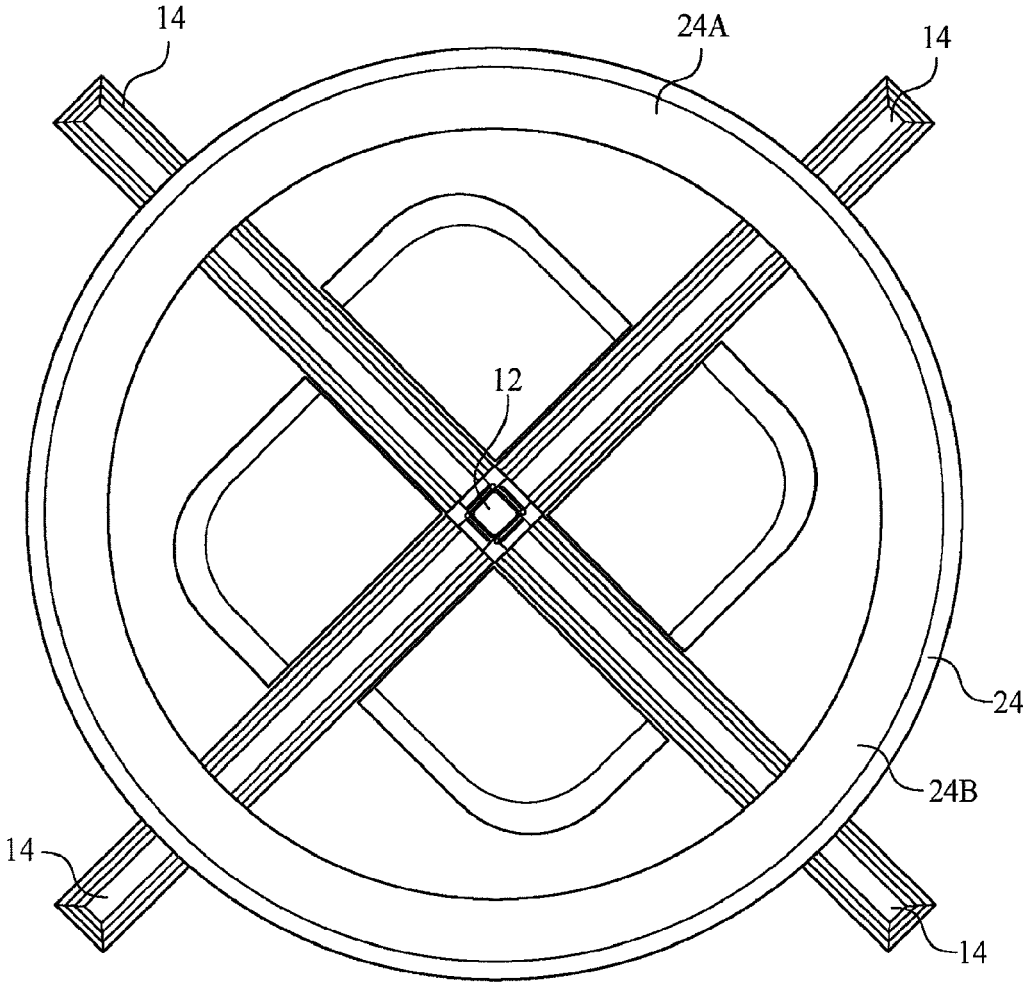
FIG. 2 is a top view of a first configuration of the merchandise display system according to the present invention.
Figure 3:
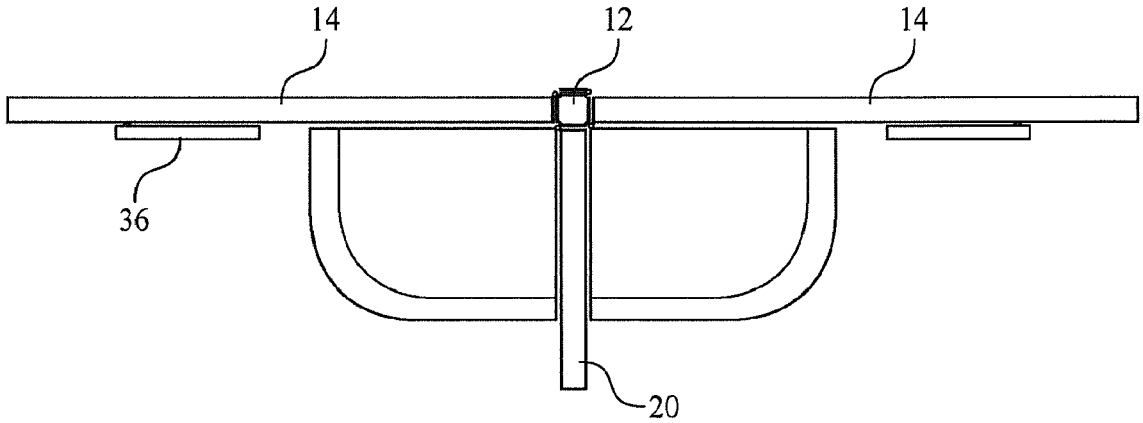
FIG. 3 is a top view of a second configuration of the merchandise display system according to the present invention.
Figure 4:
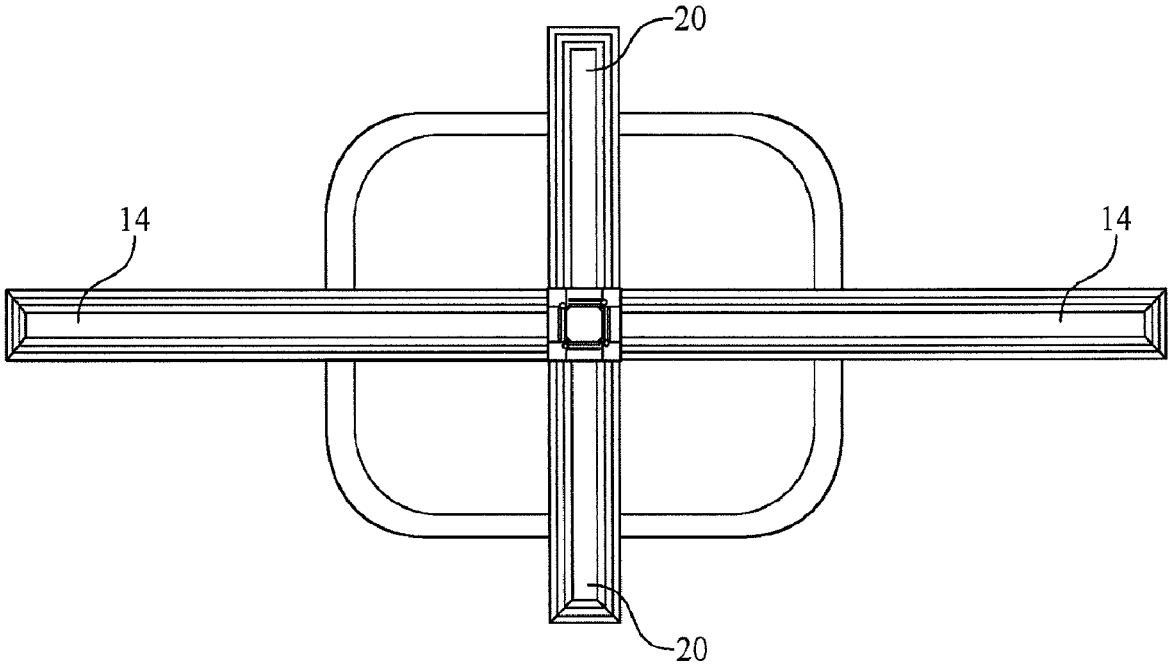
FIG. 4 is a top view of a third configuration of the merchandise display system according to the present invention.
Figure 5:
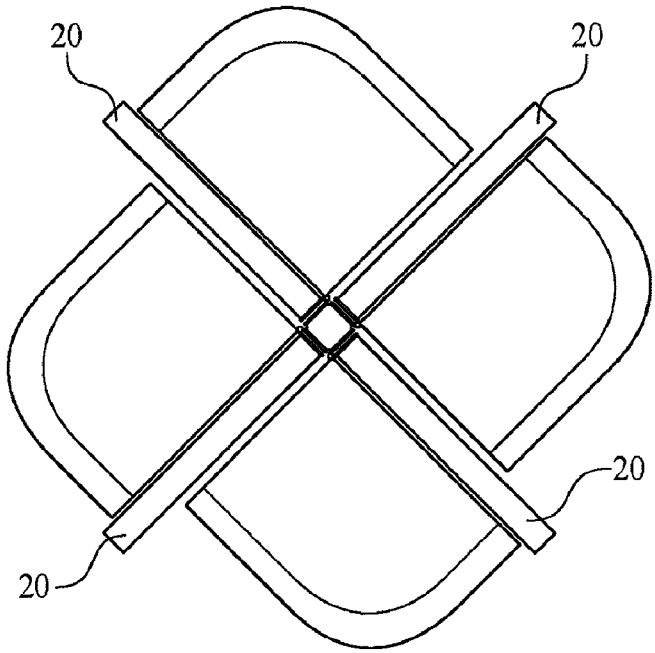
FIG. 5 is a top view of a fourth configuration of the merchandise display system according to the present invention.
Figure 6:
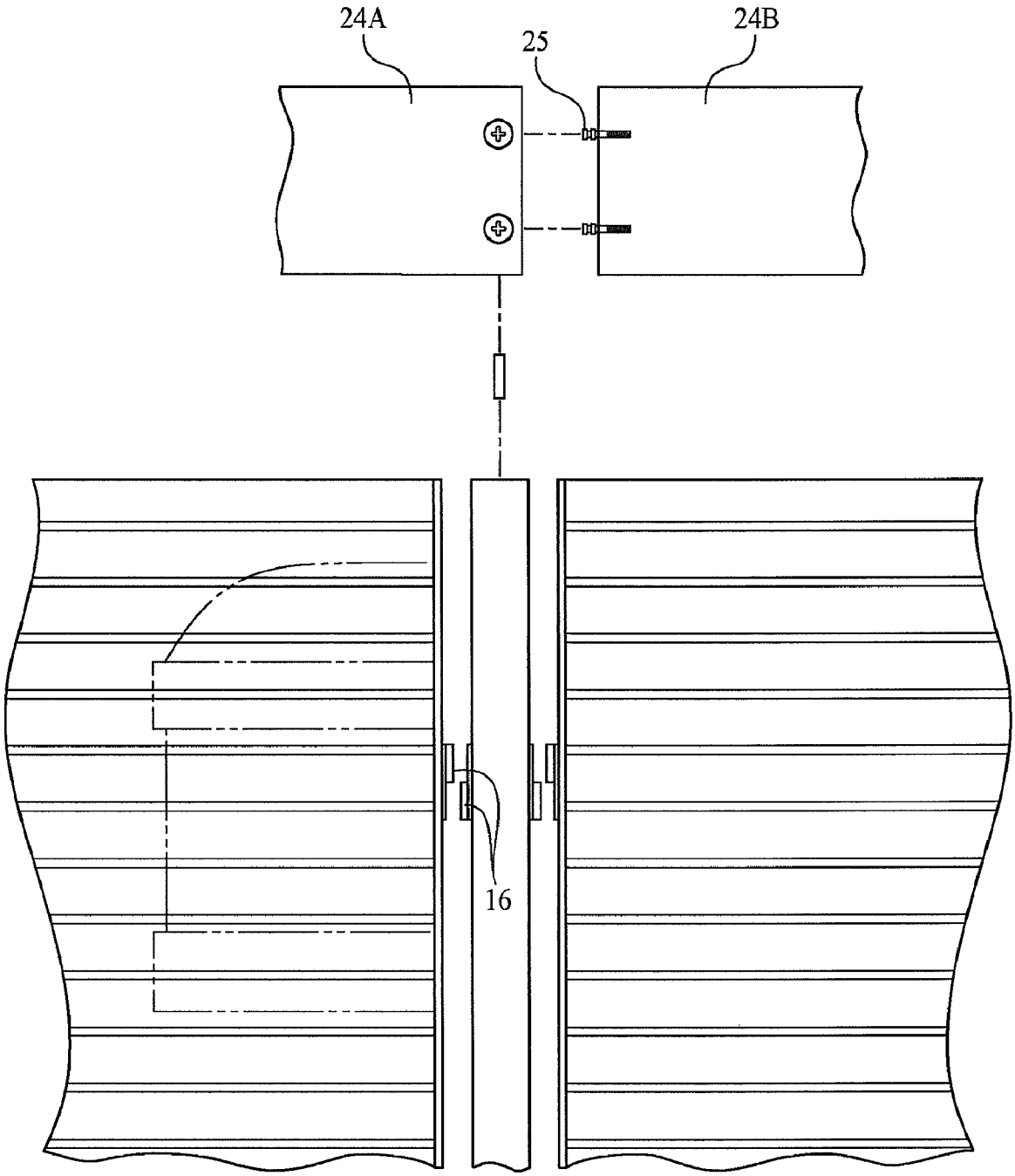
FIG. 6 is a partial exploded view of the merchandise display system.

A 42 inch panel 14 is shown in FIGS. 1 and 2. However, the panels are preferably available in two sizes, a longer 42 inch panel 14 and a shorter 20 inch panel 20 which can be used to form a number of configurations of either three or four panels with different combinations of different sized panels. FIG. 3 shows a configuration having three panels attached to the center post 12 including two longer panels 14 and a shorter panel 20. FIGS. 4 and 5 show X-type configurations of four panels. FIG. 4 shows alternating shorter panels 20 and longer panels 14 while FIG. 5 shows four shorter panels 20.

Figure 9B:
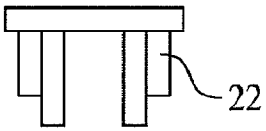
FIGS. 9A and 9B are end and perspective views of the trim assembly.
Figure 9A:
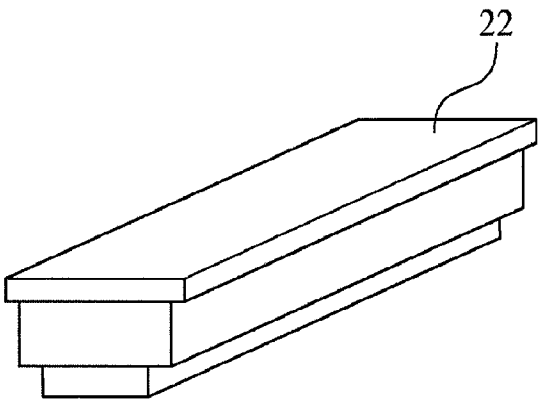

The display system further preferably includes a trim kit which includes a crown unit comprising a decorative cornice 22 which is designed to slide over the top edges of panels without the use of tools. This is best seen in FIGS. 9A and 9B. The display system further includes a plinth block 23 that caps the center of the display. Decorative cornice 22 installs against plinth block 23.

The display system further preferably includes a lighting attachment in the form of a light ring 24 (FIGS. 1, 2 and 6) attachable to the top edge of the display unit panels 14 without the use of tools. Light ring 24 comprises a circular unit formed of two semicircular portions 24A connected together by fasteners 25. Light ring 24 has lighting fixtures 26 on the underside thereof to light the display.

Figure 8:
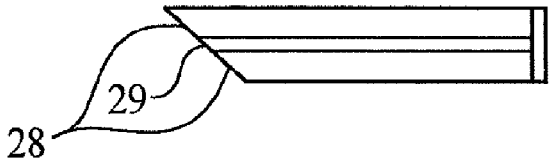
FIG. 8 is a partial top view of the merchandise display system.
Figure 7:
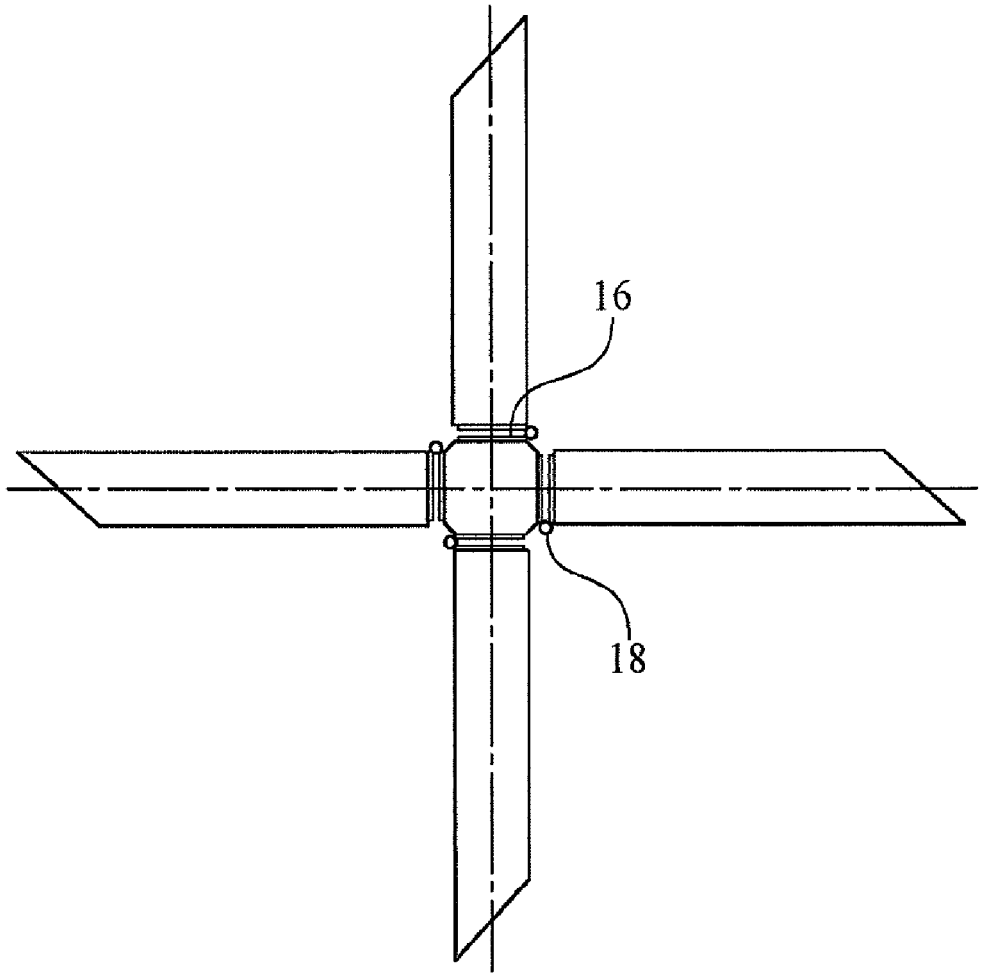
FIG. 7 is a top view of the merchandise display system.
Figure 10C:
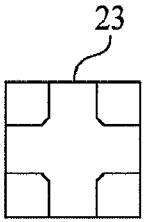
FIGS. 10A, 10B and 10C are top, end and perspective views of the center portion of the trim assembly.
Figure 10B:
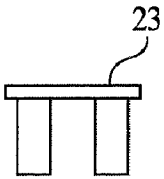
Figure 10A:
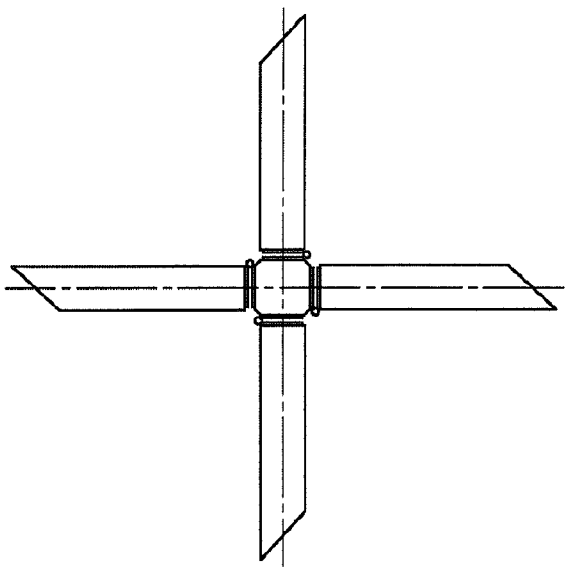
Figure 11B:
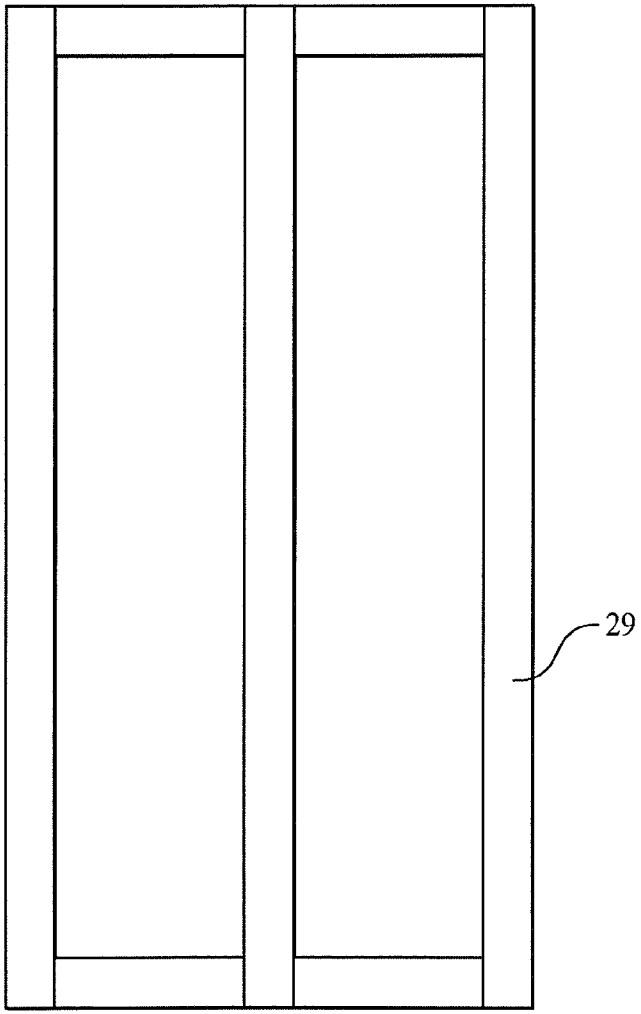
FIGS. 11A and 11B are views of the sidewall and internal stiffener.
Figure 11A:
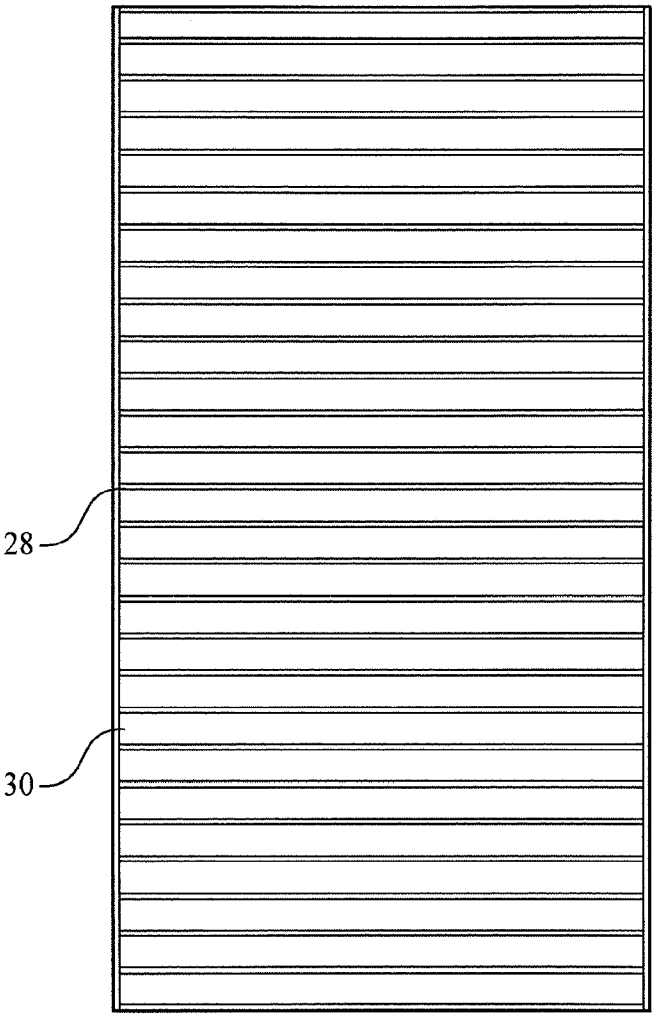
Figure 12B:
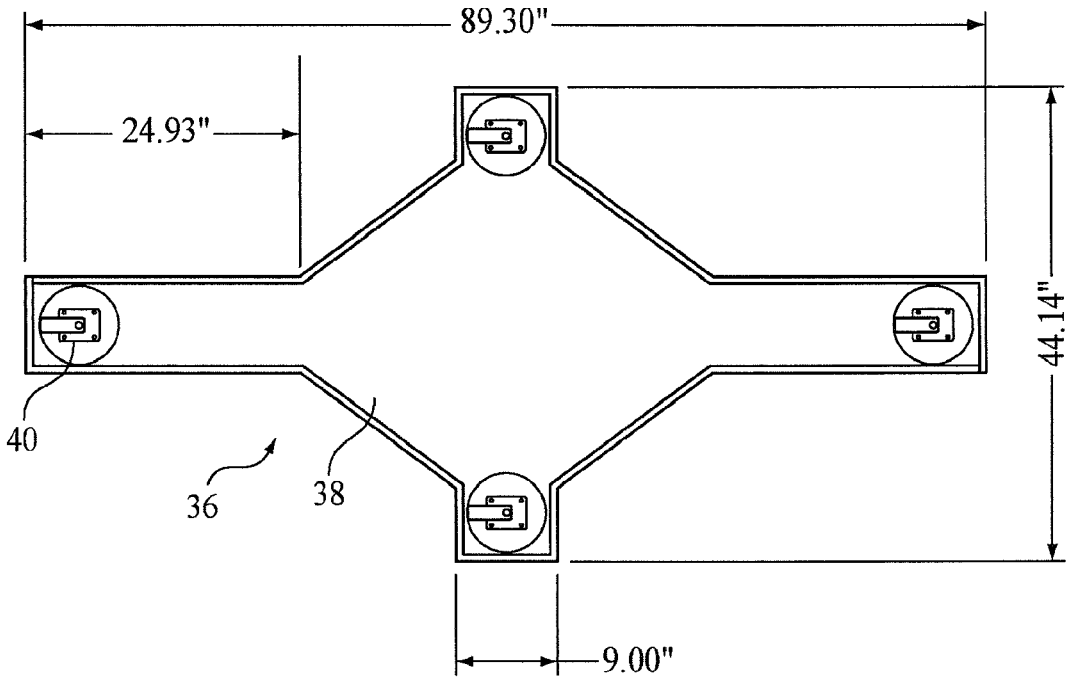
FIGS. 12A and 12B are top and side views of the wheeled carrier.
Figure 12A:
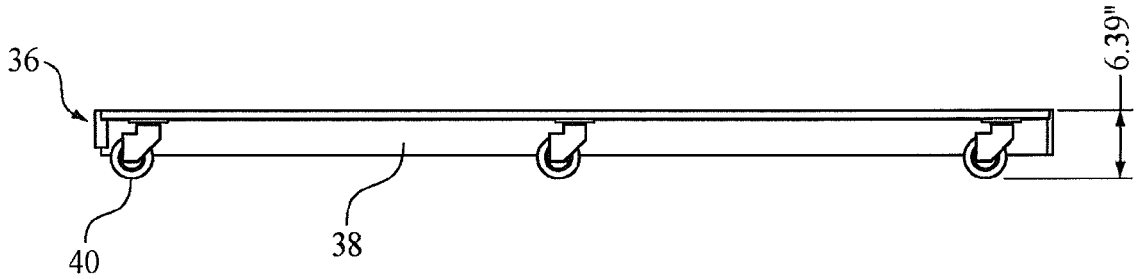
Figure 13B:
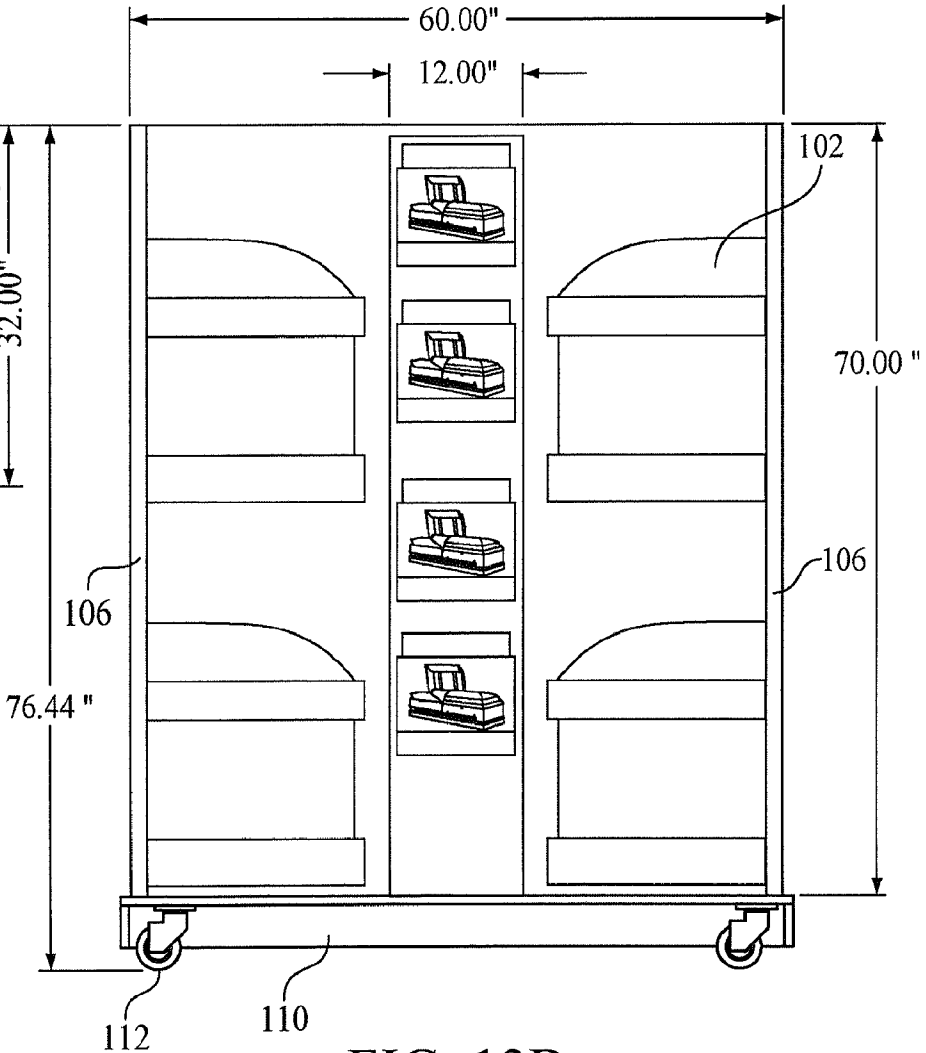
FIGS. 13A-15D illustrate another embodiment of a death care merchandise display of the present invention.
Figure 13A:
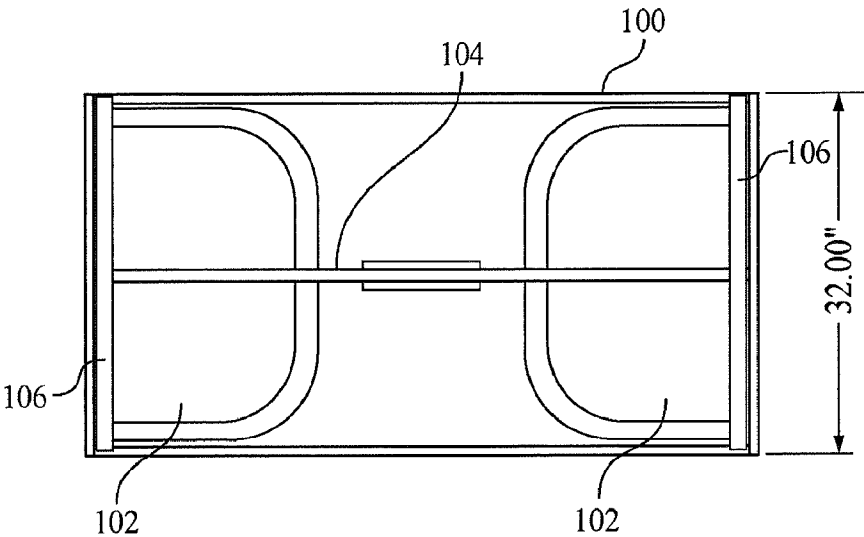
Figure 14B:
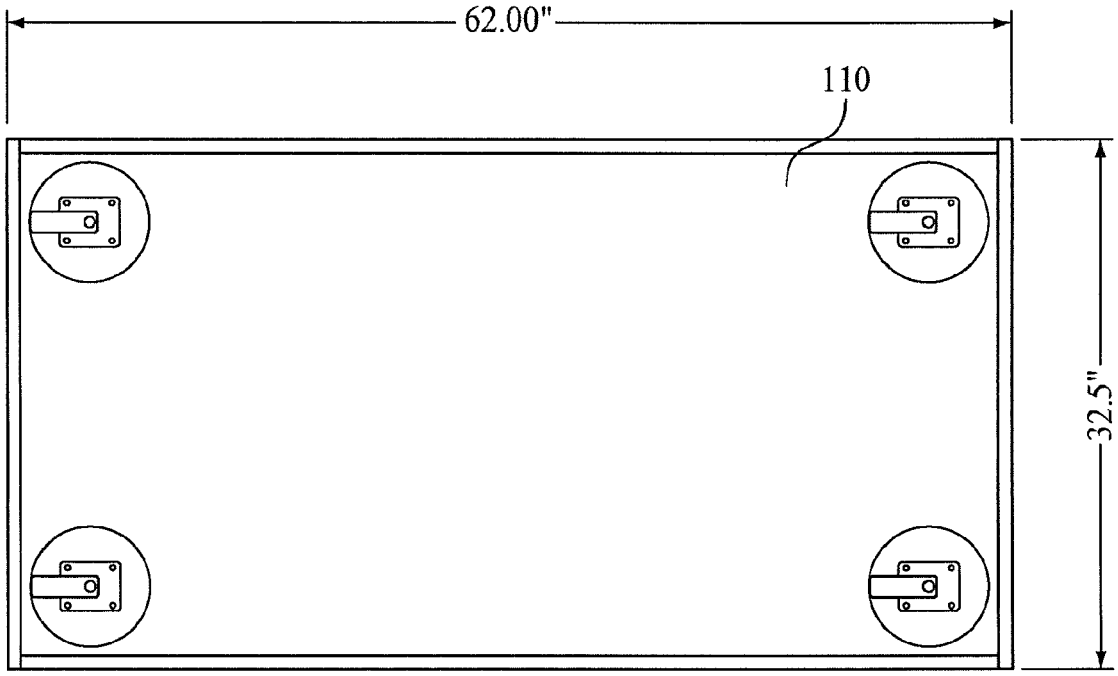
Figure 14A:
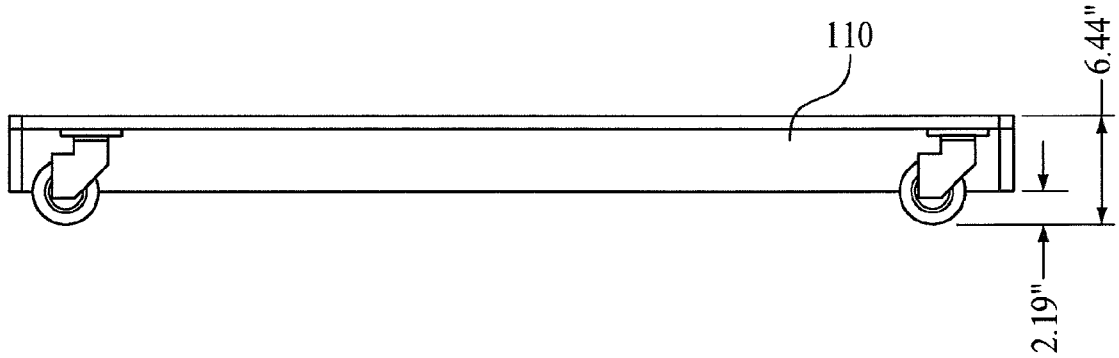
Figure 15C:
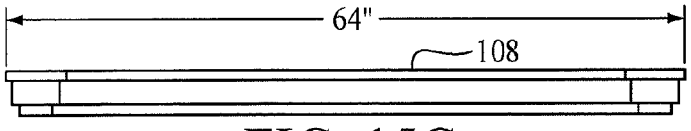
Figure 15A:
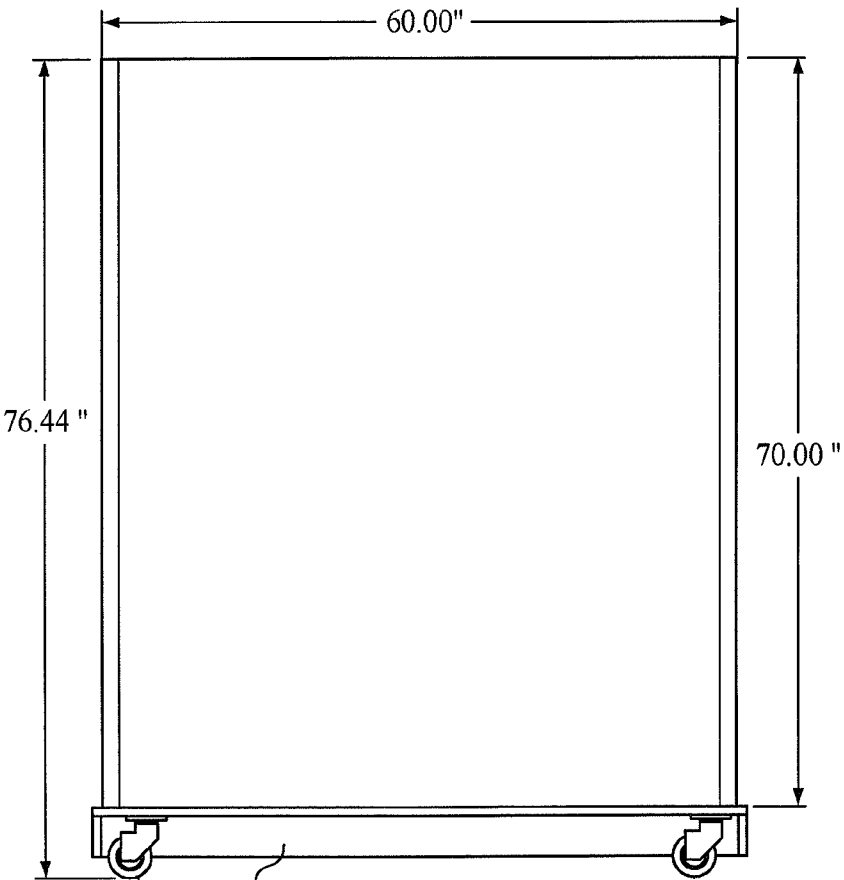
Figure 15D:
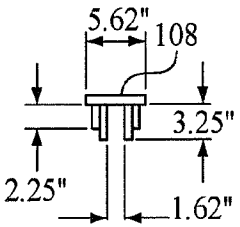
Figure 15B:
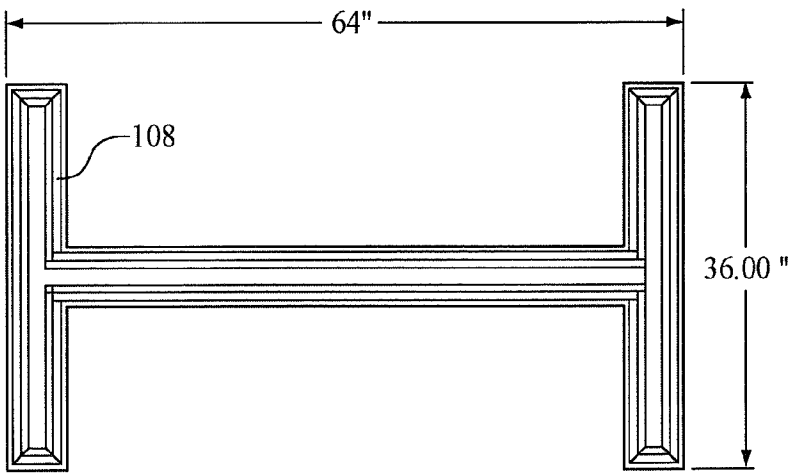

The panels 14, 20 may include slatwalls 28 including a plurality of horizontal grooves or slots 30 forming a "slatwall" arrangement (FIGS. 1, 8, 11A-B). FIG. 8 shows a panel arrangement having two slatwalls 28 with a stiffener 29 therebetween. As best seen in FIG. 11B, stiffener 29 has a "rail and stile" construction to reduce weight. Death care merchandise 32 may be displayed by mounting the merchandise 32 to the slots 30 in the slatwalls. The merchandise 32 includes hooks (not shown) which are engageable with the slots 30. Alternatively, the merchandise 32 sits on shelves 34 which have hooks engageable with the slots 30 in a known manner. The merchandise displayed may include "quarter caskets", "eighth caskets", urns, and death care accessories. The casket portions are preferably mounted in the corner formed between two panels and may be arranged two or three high. Information about the merchandise may also be displayed, for example, in a clear acrylic holder 36 (FIG. 3). Alternatively, the death care merchandise may be attached to the panels by shelves.

To enhance the portability and flexibility of the system, the present invention may also include a wheeled carrier 36 (FIGS. 12A and 12B) including a base 38 and wheels 40. The panels may be assembled on the base without tools.

Another embodiment of the present inventions is illustrated in FIGS. 13A-15D. This embodiment includes a portable two-sided display suitable for small locations without permanent display space, lobby displays, additional merchandise selections or memory displays. This embodiment allows for four to eight casket fractions 102 to be displayed in a minimum amount of space. The display of this embodiment includes a center panel 104 and two end panels 106 attached to the end of the center panel. The center panel and end panel form four interior corners to which at least eight casket fractions may be attached. Optional slat wall center panels (either narrow 12" or wide 45") maybe attached to each side of the center panel for display of photos, pictures, information and the like. The display is sized so that it can fit through a 3' by 6'8" door. Optionally, the display has a decorative drop-on cornice molding 108 and appropriate plinth block. To enhance the portability and flexibility of the display, the present invention may also include a wheeled carrier including a base 110 and wheels 112. Optionally, the display may be used for a combination casket display, family memory display or a cremation display. Optionally, the display may have all slatwall panels for the display of urns, stationary and the like. When displaying caskets, the display is suitable for four quarter caskets or eight eighth caskets.

Although the present invention has been described in detail for the purpose of illustration, it is to be understood that such detail is solely for that purpose and that variations can be made therein by those in the art without departing form the spirit and scope of the invention.

What is claimed is:

1. A death care merchandise display system for displaying death care merchandise including at least one casket fraction, the system comprising:

a vertical center post having four vertical sides, wherein adjacent sides are at right angles to each other;

at least one center post hinge plate mounted on each vertical side of the center post;

a plurality of panels attached to the center post at right angles to each other forming at least one interior corner;

at least one panel hinge plate mounted on each panel for attaching the panel to the center post;

a plurality of hinge pins, each hinge pin corresponding to one of the panel hinge plates for attaching a panel hinge plate to a center post hinge plate; and a slat wall attachable to each panel and adapted for supporting death care merchandise, each slat wall including a plurality of horizontal slots engageable with merchandise supporting devices, wherein each interior corner is adapted to support at least one casket fraction between two adjacent panels.

2. The death care merchandise display system of claim 1, further comprising a decorative cornice toollessly attached to a top edge of each panel, wherein each cornice includes a portion adapted to slide over the top edge of each panel.

3. The death care merchandise display system of claim 1, wherein at least one panel is a different length than the other panels, wherein the length of each panel is measured from the edge adjacent the center post to the outer edge of the panel when attached to the center post.

4. The death care merchandise display system of claim 1, further comprising a lighting system supported by the panels.

5. The death care merchandise display system of claim 1, further comprising a wheeled carrier for supporting the panels and post, wherein each carrier has a base and a plurality of wheels attached thereto, and wherein the panels and post are supported on the base.

6. The death can merchandise display system of claim 1, wherein the plurality of panels comprises four panels.

7. The death care merchandise display system of claim 1, wherein the plurality of panels comprises four panels.

8. The death care merchandise display system of claim 1, further comprising a plinth block for capping the post.

9. A death care merchandise display kit for a system displaying death care merchandise including at least one casket fraction, the kit comprising:

a center post having four vertical sides, wherein adjacent sides are at right angles to each other;

at least one center post hinge plate mounted on each vertical side of the center post;

a plurality of panels attachable at right angles to the center post forming at least one interior corner, each panel including a slat wall attached to each panel adapted for supporting, death care merchandise, each slat wall including a plurality of horizontal slots engageable with merchandise supporting devices, at least one panel hinge plate mounted on each panel wherein each interior corner is adapted to support at least one casket fraction;

a plurality of cornice units, each cornice unit having a portion adapted to toollessly slide over the top edge of each panel;

a plurality of hinge pins, each hinge pin corresponding to one of the panel hinge plates for attaching a center post hinge plate to a panel hinge plate; and a wheeled carrier having a base and a plurality of wheels attached hereto;

wherein the plurality of panels includes at least one panel having a different length than the other panels, wherein the length of each panel is measured from the edge adjacent the center post to the outer edge of the panel when attached to the center post.

10. The death care merchandise display kit of claim 9, further comprising a light assembly.

11. The death care merchandise display kit of claim 9, further comprising a plinth block for capping the post.

* * * * *